United States Patent [19]

Godfrey

[11] Patent Number: 4,467,854

[45] Date of Patent: Aug. 28, 1984

[54] CONNECTOR FOR DISPLAY SYSTEMS

[76] Inventor: H. Glenn Godfrey, 1005 Manchester Dr., Cary, N.C. 27511

[21] Appl. No.: 332,667

[22] Filed: Dec. 21, 1981

[51] Int. Cl.[3] ..... A47G 5/00

[52] U.S. Cl. ..... 160/135

[58] Field of Search ..... 160/135, 351, 23 R; 52/36, 239, 282, 285

[56] References Cited

U.S. PATENT DOCUMENTS

| | | | |
|---|---|---|---|
| 2,142,005 | 12/1938 | Roberts | 52/36 |
| 2,319,278 | 5/1943 | Urbain | 52/36 |
| 3,037,593 | 6/1962 | Webster | 160/135 |
| 3,224,489 | 12/1965 | Haberthier | 160/135 |
| 3,592,289 | 7/1971 | Aysta | 160/135 |
| 4,001,987 | 1/1977 | Coulthard | 52/239 |
| 4,220,189 | 9/1980 | Marquez | 160/23 R |

*Primary Examiner*—Peter M. Caun

*Attorney, Agent, or Firm*—Mills & Coats

[57] ABSTRACT

An improved connector for display systems such as those used at conventions, public meetings, and the like to display advertisements, merchandise and such. This connector is in the form of an angle channel member formed from aluminum or other suitable material with a plastic U-shaped channel member affixed thereinto to provide a relatively rigid and yet flexible connection which can be readily assembled and disassembled as well as having the capacity to receive additional structural members during use.

1 Claim, 4 Drawing Figures

CONNECTOR FOR DISPLAY SYSTEMS

FIELD OF INVENTION

This invention relates to connecting means and more particularly to an improved connecting means used in conjunction with display systems and the like.

BACKGROUND OF INVENTION

As modern merchandising concepts have developed, contact displays have been more and more resorted to, particularly in trade shows, conventions, and similar locations where the showing off of merchandise and advertising material is prevalent. Portable screen-like structures have come into common use, many covered with fabrics or similar materials and in many instances are of the folding screen type.

All of the prior known display systems have been relatively heavy to transport, are bulky in structure and many are relatively complex in construction and operation.

BRIEF DESCRIPTION OF INVENTION

After much research and study into the above-mentioned problems, the present invention has been developed to provide a relatively lightweight, nonbulky structure which can be easily transported from place to place and can be readily set up either on the floor or on any suitable preexisting means such as a table. It is readily connectable and disconnectable and yet is sturdy when in the use mode. The system also allows for additional structure to be added as desired without modification or expensive accessory structure.

The above is accomplished through the use of a relatively rigid base channel with a flexible or less rigid insert channel fixed thereto. This allows the various parts of the present invention to slip together in retained relationship and yet allows either more or less structure to be used without causing an overtight connection or a loose unit.

In view of the above, it is an object of the present invention to provide a connecting means for screen type displays which will accommodate varying size units, one as readily as the other.

Another object of the present invention is to provide a union channel between screen type display units which will accommodate accessory items.

Another object of the present invention is to provide a joint between panel type members wherein a portion of such joint is relatively rigid and a portion of such joint is relatively flexible.

Another object of the present invention is to provide a flexible securing means which is constructed at least in part of material which will flex when under strain.

Another object of the present invention is to provide a means for releasably uniting at least two members wherein said union includes a member having adequate resilience to retain such members and yet has adequate flexibility to accept at least one additional member.

Other objects and advantages of the present invention will become apparent and obvious from a study of the following description and accompanying drawings which are merely illustrative of such invention.

DETAILED DESCRIPTION OF INVENTION

Figure 1:
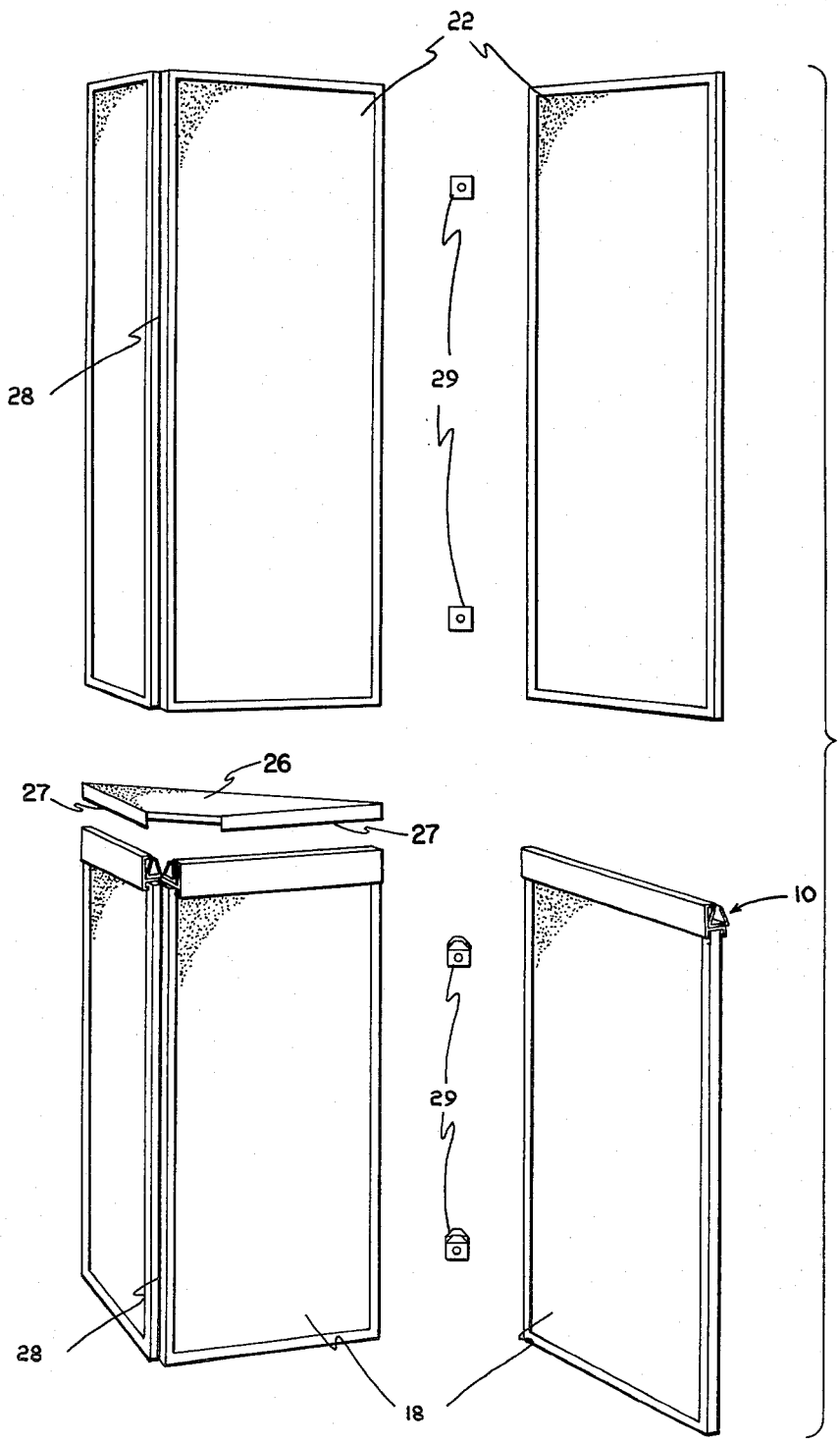
FIG. 1 is an exploded view of foldable display screens incorporating the present invention and including a removable accessory.

With further reference to the drawings, the improved connecting means of the present invention, indicated generally at 10, includes a relatively rigid portion 11 and a deflectable portion 12.

The rigid portion 11 of the present invention is preferably formed as a continuous extrusion and in cross section includes a channel shaped area 13 with a L-shaped area 14 extending therefrom.

Since this relatively rigid portion of the present invention is extruded as a single member, it gives integral rigidity to the entire connection as hereinafter described.

The flexible portion 12 of the present invention is preferably channel-shaped in cross section and is formed from a comparatively stiff but flexible plastic material.

The back portion 15 of the plastic channel portion 12 is secured to the back portion 16 of the rigid channel 13 by any suitable bonding means such as glue 17. This glue also goes part way the interior portion of the L-shaped area 14 as can clearly be seen in FIGS. 2 through 4. This side gluing not only adds strength to the bond between portions 11 and 12 but also sets one side of the plastic channel with the other channel being left unobstructed for flexing movement as necessary.

The channel area or lower portion 13 of rigid portion 11 is adapted to receive lower screen panels 18. These screen panels are preferably composed of an inner core 19 and an outer surface 20 of fabric or other suitable material. Glue or other bonding agent indicated at 21 can be used to permanently unite portion 11 to the edge of display panel 18.

Figure 4:
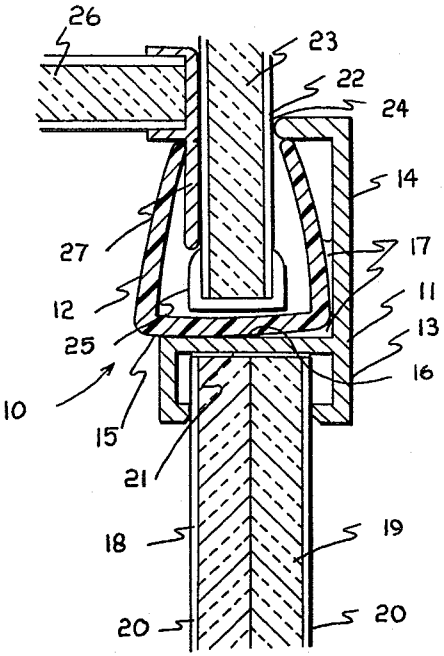
FIG. 4 is an enlarged sectional view showing the upper and lower screens in connective engagement and also supporting an accessory unit.
Figure 2:
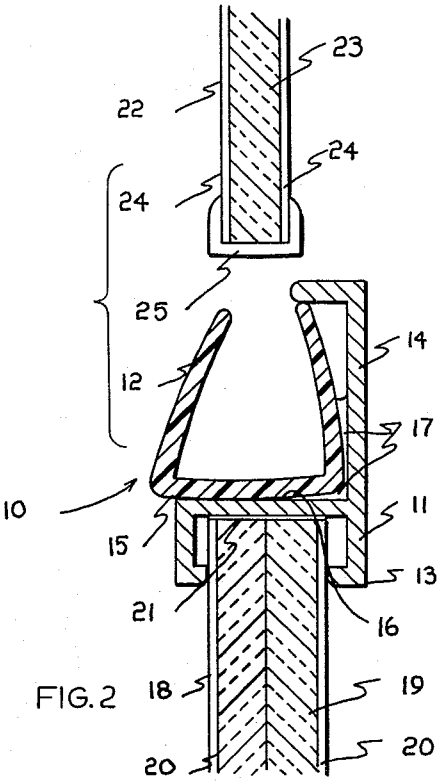
FIG. 2 is an enlarged sectional view showing the connector means prior to engagement.
Figure 3:
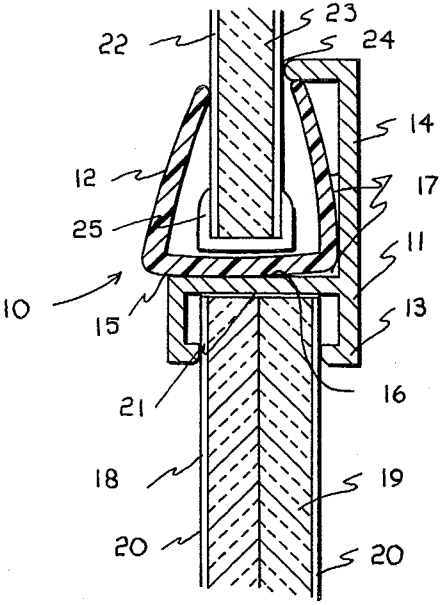
FIG. 3 is an enlarged sectional view with the upper and lower screens in connective engagement.

An upper display panel 22 includes a core 23, an outer surface of fabric or other suitable material 24 and an edge channel 25 as can be seen in the cross sectional views of FIGS. 2 through 4.

When the upper or lower display panels are to be used independently such as forming a display on a table or other surface, then, of course, the connector means of the present invention would not be used but would act simply as an ornamental edge trim. On the other hand when it is desired to stack the display panels, then two or more panels can be hingedly connected either by internal hinges as indicated at 28 or through use of clip connectors shown at 29. In either case the lower panels are set up in zig-zag configuration with the connector means 10 of the present invention being disposed on upper edges thereof. Next the lower edge of the upper panels are inserted into the deflectable channel 12 as shown clearly in FIG. 3. Because of the stiffness of the deflectable channel members 12, a gripping connection is formed between the upper and lower panels and the same can then be used to display advertising materials and other displays.

If it is desired to add additional structures to the display system such as shelf 26 to hold brochures or other display material or equipment, the vertical tabs 27 on shelf 26 are simply inserted into the deflectable channel 12 beside the upper display panel 22 as shown clearly in FIG. 4. Because of the angular disposition between sets of upper and lower panels, a rigid support for shelf 26 is provided.

Although a shelf has been described as an accessory which can be used in conjunction with the connecting means without modification, any number of other structures can, of course, also be used by simply sliding them down into channel 12 adjacent the display panel previously inserted thereinto.

Disassembly of the display system utilizing the improved connecting means of the present invention requires simply removing such portions from the gripping retention of the deflectable plastic channel member 12 bonded to the rigid connector portion 11.

Pairs of panels as hereinabove described can be connected to other pairs of panels by hinge means 28 formed from any suitable flexible material. Since flexible hinge means and are well known to those skilled in the art, further detailed discussion of the same is not deemed necessary.

From the above, it is obvious that the present invention has the advantage of providing a simple, relatively inexpensive and yet highly efficient and extremely versatile connecting means between panel type structures such as display panels. The connector means of the present invention can be used to mount a single unit or a plurality of units as the situation dictates.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An improved connecting means comprising: a relatively rigid portion; a first foam cored, at least partially fabric covered display type panel means; glue type bonding means for securing said portion to said panel; a deflectable portion secured by glue type bonding means to said first mentioned portion and forming an elongated, expandable groove; a second foam cored, at least partially fabric covered display type panel means adapted to be snugly inserted into said expandable groove; and shelf-like accessory means including a vertical tab means for insertion into said expandable groove whereby an improved connecting means between panel-like members is provided.

* * * * *